United States Patent [19]

Irani et al.

[11] 4,179,362

[45] Dec. 18, 1979

[54] PROCESS FOR AROMATICS EXTRACTION FROM A 300°-430° F. BOILING RANGE NAPHTHA

[76] Inventors: Cyrus A. Irani, 312 Penn Lear Ct., Monroeville, Pa. 15146; Stephen S. Kasegrande, 80 Mountain Height Ave., Lincoln Park, N.J. 07035; Daniel J. McHugh, 204 W. Grant Ave., Edison, N.J. 08817; Frederic Leder, 1635 Reefview Cir., Corona Del Mar, Calif. 92625

[21] Appl. No.: 867,209

[22] Filed: Jan. 5, 1978

[51] Int. Cl.[2] ..... C10G 21/16; C10G 21/28

[52] U.S. Cl. ..... 208/321; 208/324; 208/333; 585/864; 585/868

[58] Field of Search ..... 208/321, 324, 333; 260/674 SE

[56] References Cited

U.S. PATENT DOCUMENTS

| | | | |
|---|---|---|---|
| 2,261,780 | 11/1941 | Whiteley | 208/321 |
| 2,695,322 | 11/1954 | Weedman | 208/324 |
| 3,173,966 | 3/1965 | Jones et al. | 208/321 |
| 3,291,728 | 12/1966 | Boyum et al. | 208/321 |
| 3,985,644 | 10/1976 | Eberly | 208/321 |

*Primary Examiner*—Herbert Levine

*Attorney, Agent, or Firm*—James H. Callwood; Edward H. Mazer

[57] ABSTRACT

Petroleum fractions may be separated into aromatic rich and paraffinic-rich hydrocarbon streams by the use of methanol/water mixtures having at least 10% water by volume. The paraffinic-rich stream is recovered as raffinate and the aromatic-rich as extract. After the extraction step additional water is added to the extract and raffinate streams where it acts as an anti-solvent to effect separation of the hydrocarbon from the solvent. The water and methanol are then separated for example by flash distillation or by using super critical $CO_2$ as an extraction solvent.

11 Claims, 2 Drawing Figures

FIGURE I

PROCESS FOR AROMATICS EXTRACTION FROM A 300°-430° F. BOILING RANGE NAPHTHA

BACKGROUND OF THE INVENTION

1. Field of the Invention

This invention relates to a process for solvent refining of petroleum.

2. Description of the Prior Art

Numerous solvents have been used to separate aromatic and paraffinic constituents of hydrocarbon streams. Such separation is desirable because the aromatic constituents and gasoline fractions contribute toward high octane numbers while the straight chain paraffinic constituents greatly reduce octane numbers. Furthermore, pure benzene, toluene and xylene are important raw materials in the petrochemical industry. Paraffinic hydrocarbon streams are used as constituents of heating oils and jet fuels.

The solvents used in said extraction processes must meet critical requirements of (1) being only partially miscible with the hydrocarbon feed streams, (2) having a high hydrocarbon extraction capacity and (3) having a high selectivity for aromatic hydrocarbons. High capacity is important since this reduces the amount of solvent necessary to achieve the desired separation and thereby reduces the size of the vessels and associated pumps needed for recirculation. Selectivity ($\beta$) is also important. This is defined as $$\beta = \frac{\text{(\% aromatic/nonaromatic) in extract phase}}{\text{(\% aromatic/nonaromatic) in raffinate phase}}$$

Solvents having a high selectivity require fewer stages of extraction to achieve a given degree of separation. This in effect reduces the height of the extraction vessel. Generally speaking, the higher the capacity of the solvent, the lower the selectivity. Therefore some compromise is generally made between these properties in selecting a suitable solvent for the separation desired.

Other desirable characteristics of a good extraction solvent include the following: (4) low molecular weight, (5) noncorrosiveness to the equipment at operating conditions, (6) complete stability under operating conditions, (7) easy recoverability from the hydrocarbon products and (8) low cost.

No extraction solvent has yet been discovered which satisfies all of the foregoing requirements for the separation of paraffinics and aromatics in hydrocarbon streams. A number of solvents have been used including sulfolane, N-formyl morpholine, various glycols and mixtures thereof, etc. The use of most of these solvents requires, subsequent to the extraction steps, that either the solvents or the hydrocarbon is removed from the aromatic-rich solvent phase by distillation. This requires a large amount of heat which is a major cost item in the extraction process.

The use of low molecular weight aliphatic alcohols as extraction solvents is well known in the art. For example, U.S. Pat. Nos. 1,781,421 and 1,783,203 disclose the use of substantially anhydrous alcohols for this purpose. U.S. Pat. Nos. 2,770,663 and 2,727,848 disclose that water and aliphatic alcohols can be admixed for use in solvent extraction. The specific aliphatic alcohols illustrated however are glycols rather than monohydric alcohols.

U.S. Pat. No. 3,119,767 discloses a method of separating aromatic and paraffinic constituents in hydrocarbon mixtures by use of mixtures of methanol and water or ethanol and water. The volume of water in these mixtures however is limited to 5%. As indicated therein, extraction with the use of these solvents requires subsequent distillation of the aromatic-rich solvent phase in order to recover the solvent.

U.S. Pat. No. 3,985,644 discloses separating naphtha into aromatic and paraffin-rich fractions by solvent extraction with a methanol-water mixture. The solvent is separated from the raffinate phase by lowering of the temperature of the mixture rather than by using additional water as an antisolvent.

U.S. Pat. No. 2,261,780 discloses separating naphtha into aromatic and paraffin-rich fractions by solvent extraction with a phenol-water mixture. The solvent is separated from the extract phase by the addition of a precipitant to the solvent-extract mixture. This causes the precipitation of a large portion of the oil from the primary solvent. The primary solvent mixture is then scrubbed with a secondary solvent in order to remove the remaining oil from the solvent.

U.S. Pat. No. 2,646,387 suggests a solvent recovery technique which employs liquid carbon dioxide at noncritical conditions to separate the solvent from the extract and naphthenate fractions.

There is a great incentive in seeking an extraction solvent system which would be lower in cost than those heretofore used commercially. Furthermore, there is additional incentive in seeking an extraction solvent system in which the solvents can be separated from the aromatic-solvent phase without the necessity of distillation. This invention provides a solvent extraction system meeting these requirements. The use of said systems results in a process for separation of aromatic and paraffinic hydrocarbons which is economically attractive and the solvent is quite inexpensive and can be separated from the aromatic-rich phase by simple addition of water to decrease the solubility of the aromatic-rich extracted product in the methanol solvent.

SUMMARY OF THE INVENTION

A solvent extraction system wherein an aromatic-containing petroleum fraction is separated into aromatic-rich and paraffinic-rich hydrocarbon streams by using as an extraction solvent, a mixture of methanol and water, in which the water comprises at least 10% by volume. The temperature in the extraction zone is between about 150° and 400° F. The aromatic hydrocarbons are dissolved in the solvent and upon separation from the paraffinic-rich raffinate stream, the aromatic-rich extract phase is passed to a separation zone where additional water is added to the methanol to lower the solubility of the aromatic materials in the methanol. The addition of additional water causes separation of the aromatic-hydrocarbon stream and the solvent stream, the solvent stream after reconstitution by distillation to the proper methanol water mixture being recycled to the extraction zone.

DETAILED DESCRIPTION OF THE INVENTION

A process for the separation of aromatic and paraffinic hydrocarbon constituents present in petroleum distillates which comprises the steps of (1) contacting the petroleum distillate at a temperature of about 150°-450° F. with a solvent comprising methanol and water to produce an aromatic-rich extract phase and a paraffinic-rich raffinate phase;

(2) separating the aromatic-rich extract phase from the paraffinic-rich raffinate phase;

(3) contacting the separated aromatic rich extract phase and paraffinic-rich raffinate phase with water to result in a water/methanol solvent containing at least 80% water by volume, thereby separating the aromatic-rich extract phase and the paraffinic-rich raffinate phase from their respective solvent streams and recovering as products a paraffinic-rich hydrocarbon stream and an aromatic-rich hydrocarbon stream.

The hydrocarbon feed may be any petroleum hydrocarbon fraction containing aromatics such as for example naphthas (virgin or cracked) kerosene, gasoline, heating oils, lubricating oils and residua. The boiling point of said feed may range from about 180° F. for naphtha up to and including boiling ranges of vacuum residua. Preferably, the feed stream is a hydrocarbon distillate particularly an atmospheric distillate or a lube oil fraction. More preferably, the feed stream is a light atmospheric distillate such as a naphtha, kerosene or diesel fuel. The methanol/water solvent may range from 10–40% by volume of water, more preferably 20–40% by volume of water, most preferably 25–40% by volume of water. Other monohydric alcohols, such as ethanol, propanol, butanol etc. may also be used; however, these alcohols have not been found to exhibit solvent characteristics as desirable as those exhibited by methanol. The hydrocarbon fraction is contacted with solvent in an extraction zone at a temperature of between about 150°–400° F., preferably from about 200°–350° F., most preferably about 300° F. The solvent to oil volume ratio is preferably from about 0.5 to about 5. The hydrocarbon stream is separated into a paraffinic-rich raffinate phase and an aromatic-rich solvent phase. The raffinate phase is passed out of the extraction zone and contacted with sufficient water to separate the paraffinic-rich product which is then recovered. Prior to such recovery, the raffinate phase may be passed to a flashing zone where any residual methanol-water solvent is removed and recycled to the extraction zone. The aromatic-rich solvent phase is passed from the extraction zone to a separation zone where it is contacted with water at temperatures ranging from 200°–400° F., more preferably from 250°–350° F. such that the composition of the resulting methanol-water solvent is from 50% water to 95% water, more preferably from 60% water to 85% water. Prior to recovery the aromatic-rich hydrocarbon phase also may be passed to a flashing zone where any residual methanol/-water solvent is removed for recycling to the extraction zone.

BRIEF DESCRIPTION OF THE DRAWINGS

FIG. 2 shows that by adding sufficient water so that water comprises 80% total volume of the solvent, the hydrocarbon capacity of the solvent can be reduced to 1% at 300° F., i.e. separation of the hydrocarbon and the solvent can be effected without resorting to lowering the temperature to decrease the solubility of the hydrocarbon. It can also be seen from FIG. 2 that by combining a temperature swing with water addition even greater flexibility can be obtained. Thus by lowering the temperature to 200° F. and by using the solvent so that it is 60% water, the low hydrocarbon solubility is again obtained. In fact, a large number of such single or combination cycles is feasible.

For the process as defined, it is desirable to reconstitute the solvent stream to its original composition. This can be accomplished in a number of ways, such as by flash distillation to split the methanol and water, an operation well known in the art or unconventionally by a super-critical extraction step using $CO_2$ to effect the separation.

Figure 1:
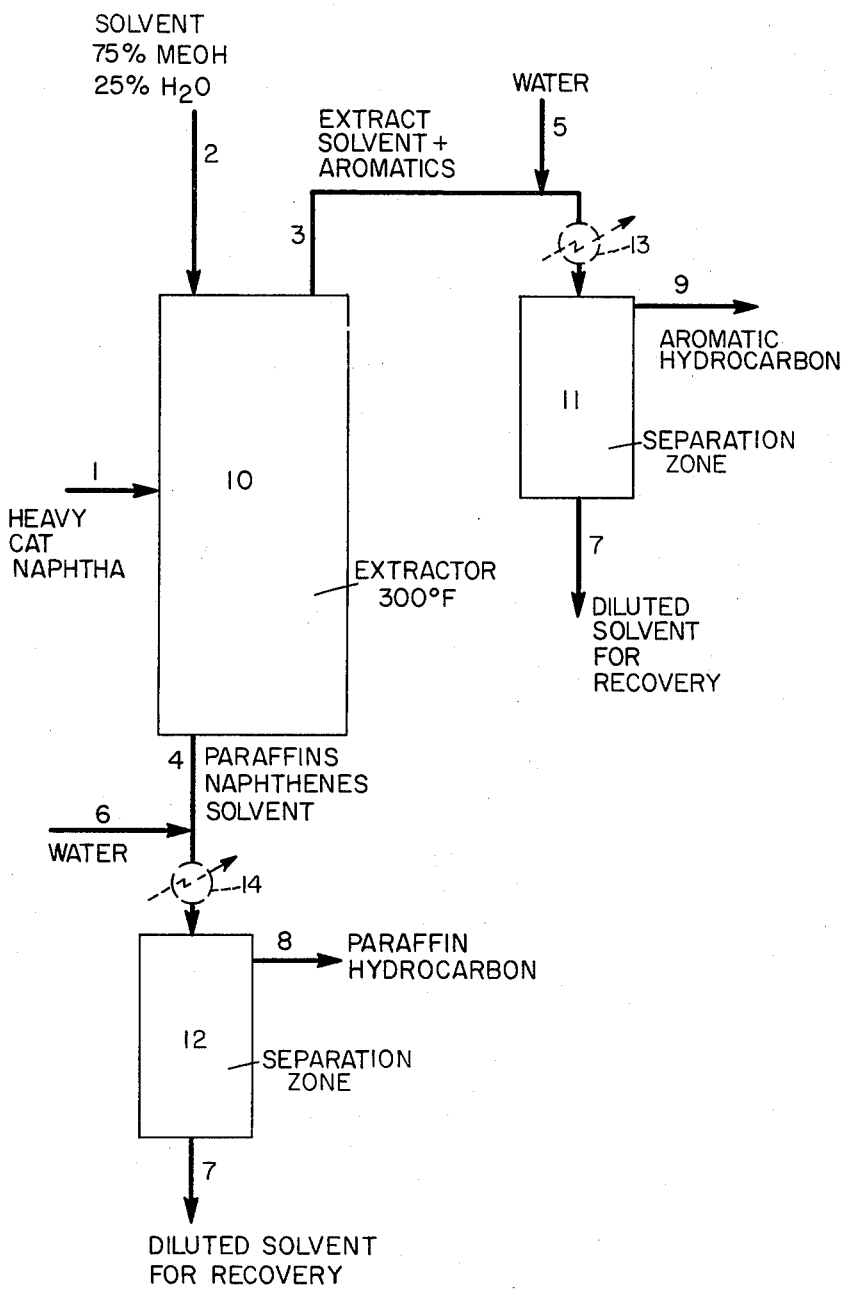
FIG. 1 of the drawings is a flow diagram showing the extraction of a catalytic naphtha by a methanol-water mixture having 25 volume % water and a temperature of 300° F.

The process will be more readily understood by reference to FIG. 1 of the drawings. A catalytic naphtha having a boiling range of 300°–430° F. enters extraction tower 10 via line 1 where it is contacted at about 300° F. with the methanol-water mixture entering via line 2 to form an aromatic-rich extract phase and a paraffinic-rich raffinate phase. The aromatic-rich extract phase is separated from the raffinate phase and passed out of extraction zone 10 into line 3 where enroute to separation zone 11, it is contacted with sufficient water entering via line 5 to constitute a solvent comprising at least 80% water at 300° F. The raffinate phase is passed out of extraction zone 10 via line 4 where enroute to a second separation zone 12, it is contacted with water entering via line 6. The raffinate phase leaving zone 10 is inherently hydrocarbon-rich, containing at most 10% solvent, and almost invariably less than 5% solvent. The introduction of additional water via line 6 serves to draw this residual solvent out of the raffinate phase and into the aqueous phase, the final separation of aqueous and hydrocarbon phases being effected in zone 12. The diluted residual solvent may then be passed to a recovery zone via line 7 where it is subjected to either flash distillation or super-critical $CO_2$ treatment (not shown) to reconstitute the solvent at at least a 25% volume ratio of water to methanol.

The raffinate paraffinic-rich stream exits from the separation zone via line 8 and is suitable, for example, as a blend in jet fuel. Alternatively, this stream can be recycled to reformer for further conversion of paraffins into hydrocarbons. The aromatic-rich hydrocarbon phase exiting from separation zone 11 via line 9 is suitable as a blending component in, for example, gasoline or it may optionally be recycled to the extraction zone. The diluted solvent exiting from separation zones 11 and 12 via line 7 is combined into a single stream and passed to a zone where it is either flash distilled or subjected to super-critical $CO_2$ treatment or reconstitution to at least 25% by volume water to methanol.

Prior to entering separator zones 11, 12 the fluid streams may be passed through optional heat exchangers 13, 14, respectively, to adjust the fluid stream temperatures as desired.

An additional aid to better understanding of this invention is the following example which is included here for the purpose of illustration only and is not intended as a limitation.

EXAMPLE

Figure 2:
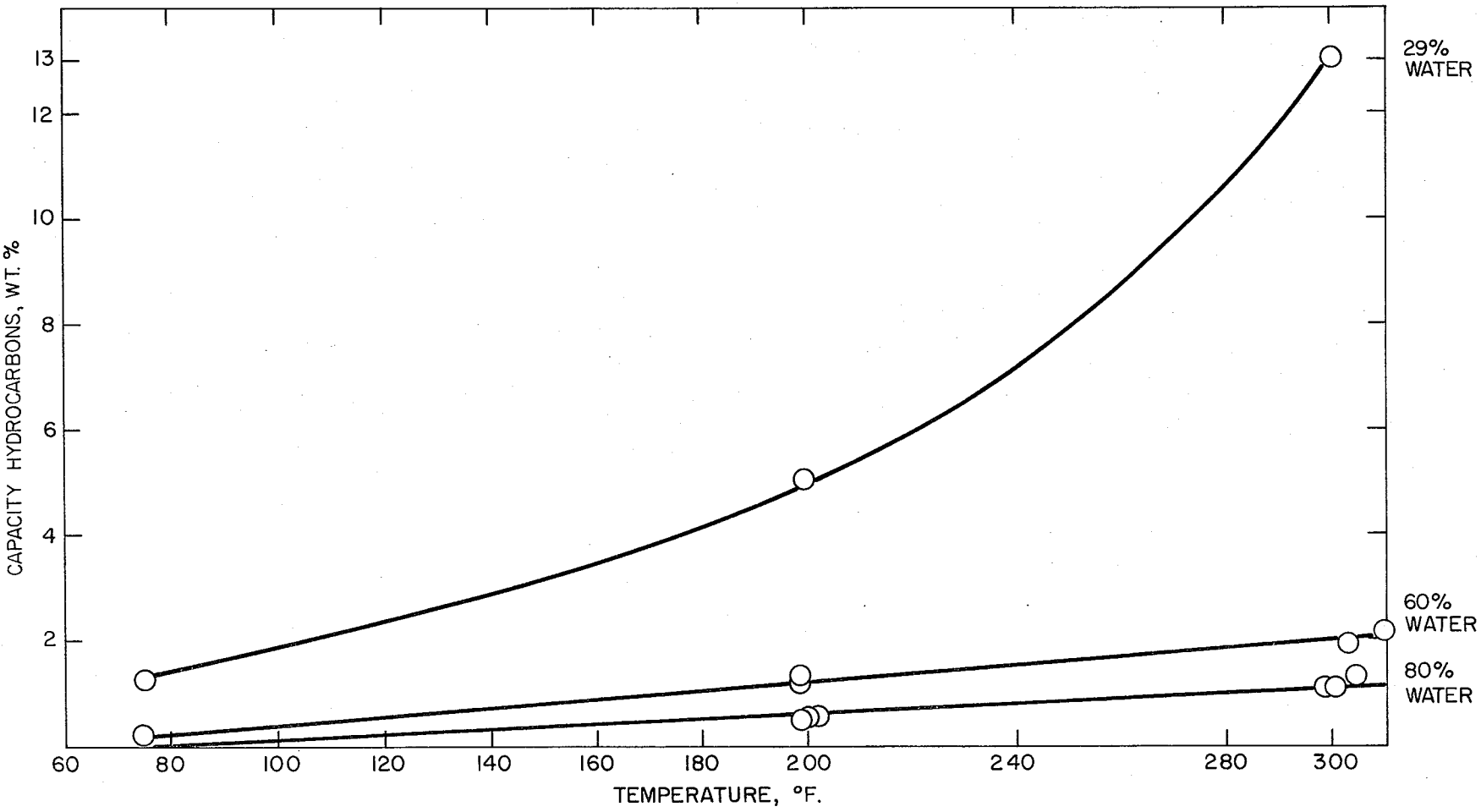
In FIG. 2 is presented data showing the methanol-water solvent capacity for hydrocarbon as a function of temperature and percentage water comprising the solvent.

The following data shown in FIG. 2 were obtained for methanol/water extraction of catalytic naphtha boiling in the range of between 200° and 430° F. These results show that the 80% $H_2O$/methanol solution has only a 1.1 wt. % capacity for hydrocarbons at 300° F. as contrasted with a 13.0 wt. % capacity for a (29% $H_2O/CH_3OH$) solvent. The 60% $H_2O/CH_3OH$ solvent showed a 2.0 wt. % capacity. Hence, the addition of large volumes allows for separation of the solvent from the hydrocarbon without the need to lower temperatures of the hydrocarbon/solvent mixtures to decrease the solubility of the hydrocarbon and the solvent. Alternatively, a temperature swing combined with water addition can be advantageously employed to yield even greater operational flexibility.

What is claimed is:

1. A process for the separation of aromatic and paraffinic hydrocarbon constituents of an aromatic-containing petroleum distillate which comprises the steps of (1) contacting the petroleum distillate at a temperature of about 150°–450° F. with a solvent comprising a mixture of methanol and water in which the water comprises at least 10% by volume to produce an aromatic-rich extract phase and a paraffinic-rich raffinate phase;

(2) separating the aromatic-rich extract phase from the paraffinic-rich raffinate phase; and (3) contacting the separated aromatic-rich extract phase and paraffinic-rich raffinate phase directly, without further processing, with water to result in a water/methanol solvent containing at least 80% water by volume, thereby separating said aromatic-rich extract phase and paraffinic-rich raffinate phase from their respective solvent streams and recovering as products a paraffinic-rich hydrocarbon stream and an aromatic-rich hydrocarbon stream.

2. The process according to claim 1 wherein the petroleum distillate is a catalytic naphtha.

3. The process according to claim 1 in which in step 1 the solvent to petroleum distillate volume ratio is from about 0.5 to about 5.

4. The process according to claim 1 wherein in step 1 the extraction temperature is between about 200° and 350° F.

5. The process according to claim 1 in which the methanol/water solvent used to contact the petroleum distillate contains from about 10 to about 40 volume % of water.

6. The process according to claim 5 in which the methanol/water solvent contains about 25 volume % of water.

7. The process according to claim 6 in which in step 3 water is added to the solvent/hydrocarbon mixture to result in a solvent containing at least 60% by volume $H_2O$.

8. The process according to claim 7 in which sufficient water is added to result in a solvent containing at least 80% water by volume.

9. The process according to claim 1 in which the paraffinic-rich hydrocarbon phase obtained in step 2 and the aromatic-rich hydrocarbon phase obtained in step 2 are separately passed to flashing zones where any residual methanol/water solvent is removed for recycling to the extraction zone.

10. The process according to claim 1 in which the reconstitution of the solvent in step 3 is accomplished by means of flash distillation.

11. The process according to claim 1 in which the reconstitution of the solvent in step 3 is accomplished by using super critical $CO_2$ as an extraction solvent.

* * * * *